US005145401A

United States Patent [19]

Archer

[11] Patent Number: 5,145,401

[45] Date of Patent: Sep. 8, 1992

[54] ELECTRICAL CONNECTOR HAVING IMPROVED SPRING CONTACTS

[75] Inventor: Lee A. Archer, Asheville, N.C.

[73] Assignee: Superior Modular Products, Inc., Swannanoa, N.C.

[21] Appl. No.: 706,388

[22] Filed: May 28, 1991

[51] Int. Cl.[5] ..... H01R 4/24

[52] U.S. Cl. ..... 439/395; 439/676

[58] Field of Search ..... 439/389–425, 439/676, 741, 743, 629–637

[56] References Cited

U.S. PATENT DOCUMENTS

| | | | |
|---|---|---|---|
| 3,348,191 | 10/1967 | Kinkaid | 439/741 |
| 3,587,029 | 6/1971 | Knowles | 439/741 |
| 4,202,593 | 5/1980 | Abernethy et al. | 439/676 |
| 4,333,700 | 6/1982 | Pugh . | |
| 4,431,246 | 2/1984 | Vaden . | |
| 4,580,864 | 4/1986 | Knickerbocker | 439/395 |
| 4,648,678 | 3/1987 | Archer . | |
| 4,773,875 | 9/1988 | Huiskes | 439/395 |
| 4,875,875 | 10/1989 | Archer et al. | 439/676 |
| 4,909,754 | 3/1990 | Paradis | 439/395 |
| 4,975,078 | 12/1990 | Stroede et al. | 439/676 |

*Primary Examiner*—Joseph H. McGlynn
*Attorney, Agent, or Firm*—Carter & Schnedler

[57] ABSTRACT

There is provided a jack connector for intermating with a corresponding plug connector. The jack includes a housing which receives a plurality of elongated contacts. Each contact has an arcuate portion which is wider than its adjacent bearing portion. The housing includes a ledge and an adjacent space so that the contact may deflect within the space when force is applied to the bearing portion. Each contact includes a wire termination portion having a substantially zero clearance insulation displacement contact. Each insulation displacement contact is supported by shoulders so as to avoid damage to the contact when a wire is terminated thereto.

29 Claims, 4 Drawing Sheets

ELECTRICAL CONNECTOR HAVING IMPROVED SPRING CONTACTS

BACKGROUND OF THE INVENTION

This invention relates to electrical connectors. More particularly it relates to modular jacks commonly known as FCC connectors.

The Federal Communications Commission has adopted certain architectural standards with respect to electrical connectors utilized in the telephone industry so as to provide intermateability. These connectors are commonly referred to as FCC type modular plugs and jacks. The plug is commonly terminated to a plurality of wires which may be connected to a telephone handset or other communicating device. The corresponding jack is commonly mounted to a panel such as a wall plate and terminated to a plurality of wires which lead to a telecommunication network.

A typical plug is described in U.S. Pat. No. 4,431,246 and a typical jack is described in U.S. Pat. No. 4,648,678. The outer dimensions of the plug, along with the entry dimensions of the jack are such that plugs may be snap fitted into corresponding jacks. Each plug includes a plurality of spaced apart contacts, usually four, six or eight fixed contacts, located on spaced apart centers, again the spacing being controlled by FCC specifications. The jack includes a plurality of spring contacts which again are spaced apart pursuant to FCC specifications so as to align with and make proper electrical contact with the corresponding fixed contacts of the plug.

Because the contacts of the jack are spring contacts and thus movable, problems sometimes arise with the jacks because of overdeflection of the spring contacts. Once a spring contact is overdeflected, it more than likely will not return to its original position within the jack resulting in failure of the connection. The overdeflection can occur under normal use but more than likely will occur because of abuse or because of the common practice of one inserting a six contact plug into an eight contact jack. Because the six contact plug normally has plastic shoulders which extend above the normal level of the contacts, the outer two contacts of the jack will become overdeflected when the six contact plug is placed in the eight contact jack. Poor mechanical design of the jack contacts or the selection of inappropriate contact materials or a combination of both will exacerbate the problem. Because of this problem of overdeflection, often connector manufacturers have resorted to the use of expensive materials in the manufacture of spring contacts such as, for example, beryllium copper alloys. Beryllium copper is known to have better spring properties than the less expensive phosphorous/bronze alloys. Depending on the current market for the metals, often the beryllium copper alloys are five times more expensive than phosphorous/bronze alloys. Cost becomes an additional problem because of the large amount of waste of materials which occurs during the manufacture of the contacts. Furthermore, the contact manufacturer is unable to recover much from recycling the waste. It is therefore desirable to provide a jack having spring contacts made of less expensive materials and which are not prone to damage from overdeflection.

OBJECTS OF THE INVENTION

It is one object of this invention to provide an improved electrical connector.

It is another object to provide an improved FCC type jack.

It is still another object to provide an electrical connector having improved spring contacts.

It is yet another object to provide an electrical connector having spring contacts which may be made of inexpensive materials without substantially increasing the risk of damage due to overdeflection of the contacts.

It is another object to provide an improved electrical spring contact.

It is another object to provide an electrical connector which provides a reduction in the likelihood of damage to its contacts.

SUMMARY OF THE INVENTION

In accordance with one form of this invention, there is provided an electrical connector having a housing which receives at least one and preferably a plurality of elongated contacts. Each contact has an arcuate portion for providing spring action to the contact. The contact has a bearing portion for engaging a corresponding mating contact. The arcuate portion, which is located in the region of greatest bending moment, is wider than the bearing portion, thereby reducing its unit stress upon maximum deflection of the elongated contact.

In accordance with another form of this invention, there is provided an electrical connector including a housing which receives at least one and preferably a plurality of contacts. Each contact has an arcuate portion for providing spring action to the contact. The contact also has a bearing portion for engaging a corresponding mating contact. The contact also includes an intermediate portion adjacent to the arcuate portion. The housing includes a shoulder. A part of the contact rests against the shoulder in the region near the interface between the arcuate portion and the intermediate portion, thereby providing a space receiving at least a part of the remainder of the intermediate portion so that such part of the intermediate portion may be free to deflect downwardly upon the application of a load to the bearing portion, thus allowing angular rotation of the arcuate portion thereby reducing its stress under the maximum deflection condition.

In accordance with still another form of this invention, there is provided an electrical connector including a housing which receives at least one and preferably a plurality of elongated electrical contacts. Each contact has an arcuate portion, a bearing portion, an intermediate portion, and a termination portion. The termination portion includes an insulation displacement mechanism. A part of the insulation displacement mechanism is sheared, thereby providing substantial zero clearance along the sheared part so as to provide increased forces on the wire which is terminated to the termination portion.

In accordance with yet another form of this invention there is provided an electrical connector including a housing which receives at least one elongated contact and preferably a plurality of contacts. Each contact has an arcuate portion, a bearing portion, an intermediate portion, and a termination portion. The termination portion includes a shoulder. The housing includes at least one land abutting against the shoulder so as to relieve stress on the remainder of the contact when a wire is terminated to the termination portion.

The various forms of the invention described above enable one to utilize less expensive materials for spring contacts in an electrical connector while greatly reducing the above-described problems associated with overdeflection of the spring contact.

BRIEF DESCRIPTION OF THE DRAWINGS.

The subject matter which is regarded as the invention is set forth in the appended claims. The invention itself, however, together with further objects and advantages thereof ma be better understood in reference to the following description taken in conjunction with the accompanying drawings in which:

DESCRIPTION OF THE PREFERRED EMBODIMENT

Figure 1:
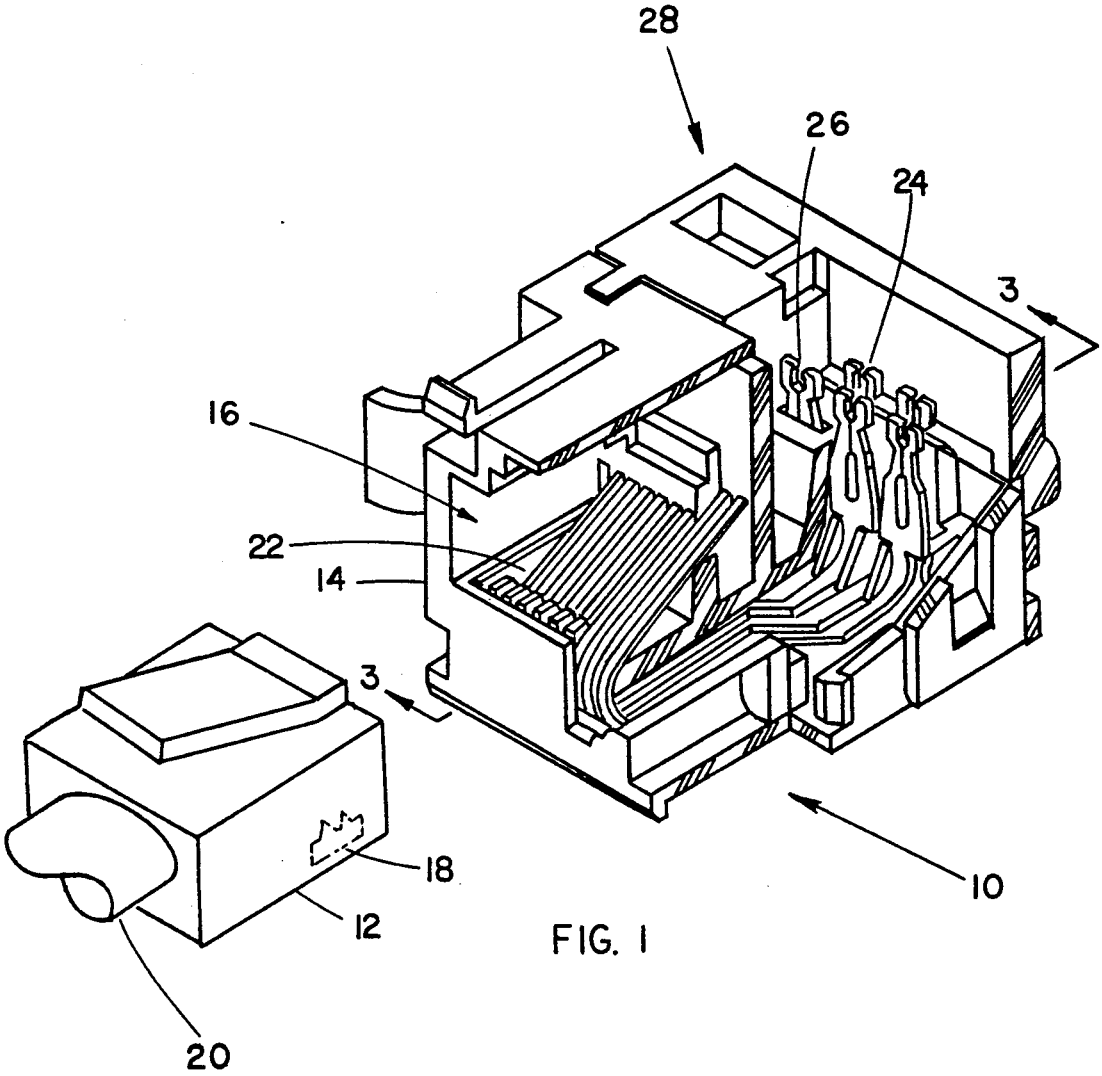
FIG. 1 is a pictorial view showing the electrical jack of the subject invention and an associated plug.
Figure 2:
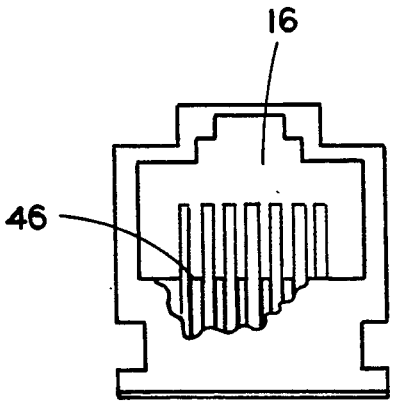
FIG. 2 is a front elevational view of the jack of FIG. 1.

Referring now more particularly to FIGS. 1 through 13, there is provided electrical connector 10 in the form of an FCC type jack. An associated FCC plug (not shown) is ready to be mated with the jack 10. Jack 10 includes plastic housing 14 having cavity 16 therein for receiving plug 12. The shape of cavity 16 is regulated by the FCC so that standard FCC plugs 12 may be received therein. Plug 12 includes a plurality of fixed contacts 18 which are terminated to the wires in cable 20. Cable 20 is normally connected to a telephone handset or other telecommunication device.

Jack 10 includes a plurality of elongated spring contacts 22. In this embodiment eight spaced apart spring contacts 22 are utilized.

Figure 3:
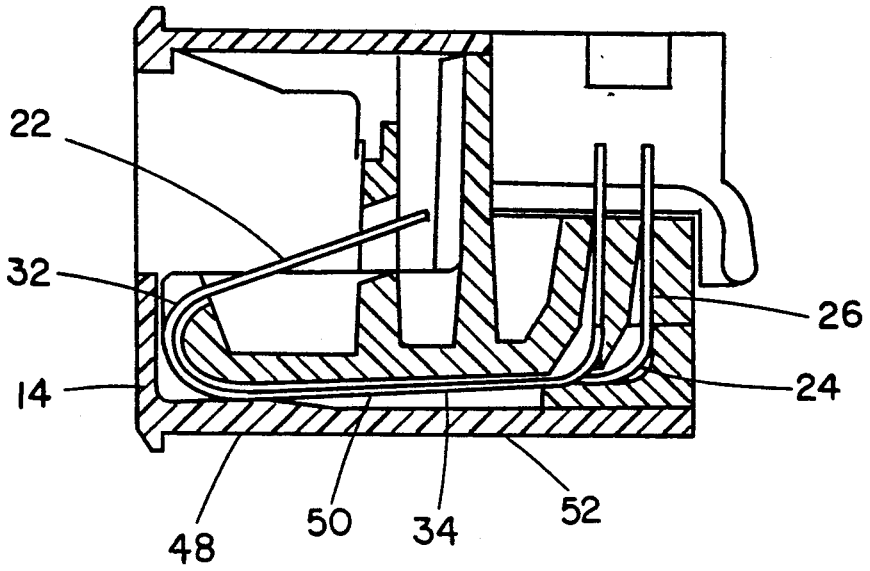
FIG. 3 is a sectional view of the jack of FIG. 1 taken through Section lines 3—3.

As can be seen from FIG. 3, there are long spring contacts 24 and short spring contacts 26 so that the contacts may be terminated to wires in an offset arrangement with alternating long and short spring contacts.

Figure 4:
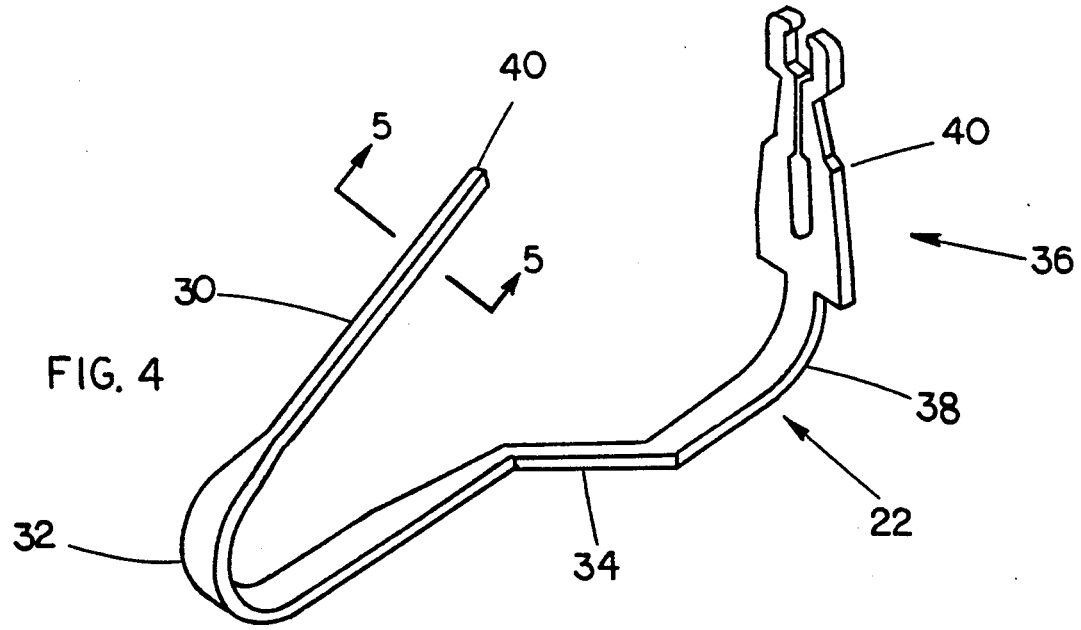
FIG. 4 is a pictorial view of one of the contacts of the jack of FIG. 1.

As can be seen from FIG. 4, each spring contact 22 includes bearing portion 30, an arcuate portion 32, a mid or intermediate portion 34, a termination portion 36, and an upward bend 38. Bearing portion 30 includes free end 40. Bearing portion 30 makes contact with a fixed contact 18 in plug 12. Arcuate portion 32 provides for the primary spring action of contact 22 to impart forces at the bearing position 30 when it is deflected. Mid portion 34 is enabled to flex downwardly when bearing portion 30 receives force from plug 12 thus relieving some of the stress in arcuate portion 32. Termination portion 36 includes insulation displacement terminal 40 which receives insulated conductor 28 for terminating the insulated conductor 28 to contact 22. Bend portion 38 is provided in order to elevate the termination portion 36 above the remainder of the contact.

Figure 5:
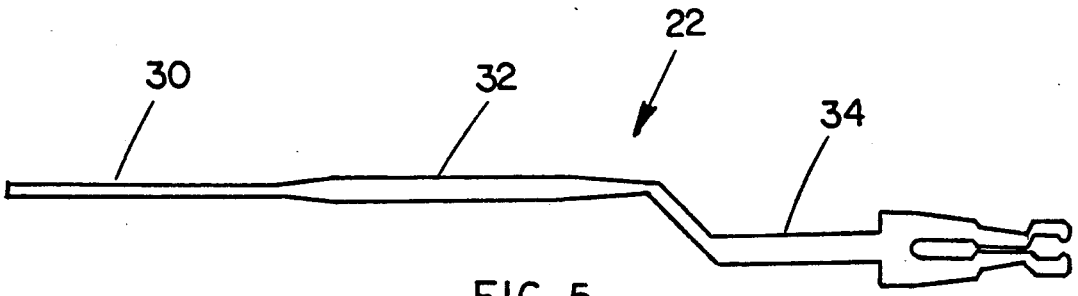
FIG. 5 is a plan view of the contact of FIG. 4 prior to it being formed into the shape shown in FIG. 4.
Figure 6:
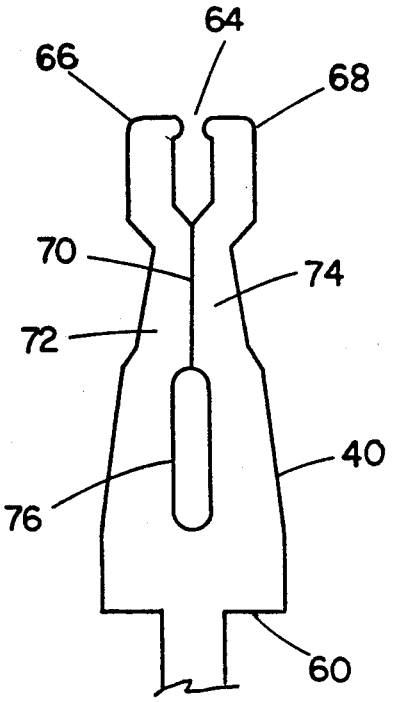
FIG. 6 is a front elevational view of the termination portion of the contact of FIG. 4.

As can be seen from FIG. 5, contact 22 is stamped from a piece of sheet metal and thus is of a thin somewhat flat design. The arcuate portion 32 is wider than the bearing portion 30 and the mid portion 34 in order to provide added strength in the arcuate portion where most of the stresses occur during deflection. Preferably the width of the arcuate portion is 0.024 inches and the width of the bearing portion 30 and the mid portion 34 are each 0.017 inches.

Figure 10:
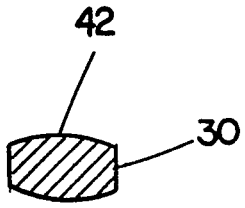
FIG. 10 is a sectional view of the contact of FIG. 5 taken through Section line 5—5.
Figure 11:
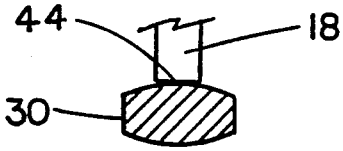
FIG. 11 shows the apparatus of FIG. 10 in contact with a corresponding plug contact.
Figure 12:
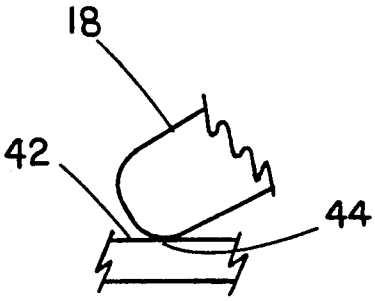
FIG. 12 is a partial side elevational view of the bearing portion of the apparatus of FIG. 4 in contact with a plug contact wherein the view of FIG. 11 has been rotated 90°.

As can be seen from FIGS. 10 and 11, side 42 of bearing portion 30 which makes contact with plug contact 18 is curved, thus contact occurs in a very small area 44 thereby resulting in extremely high pressures where contact is made which tends to cut through any surface films which are formed on the metal thereby providing a very good electrical contact.

The free ends 40 of contact 22 are guarded inside of cavity 16 by means of comb 46. Comb 46 also prevents a child's fingers from being trapped by the ends of the contact.

Figure 13:
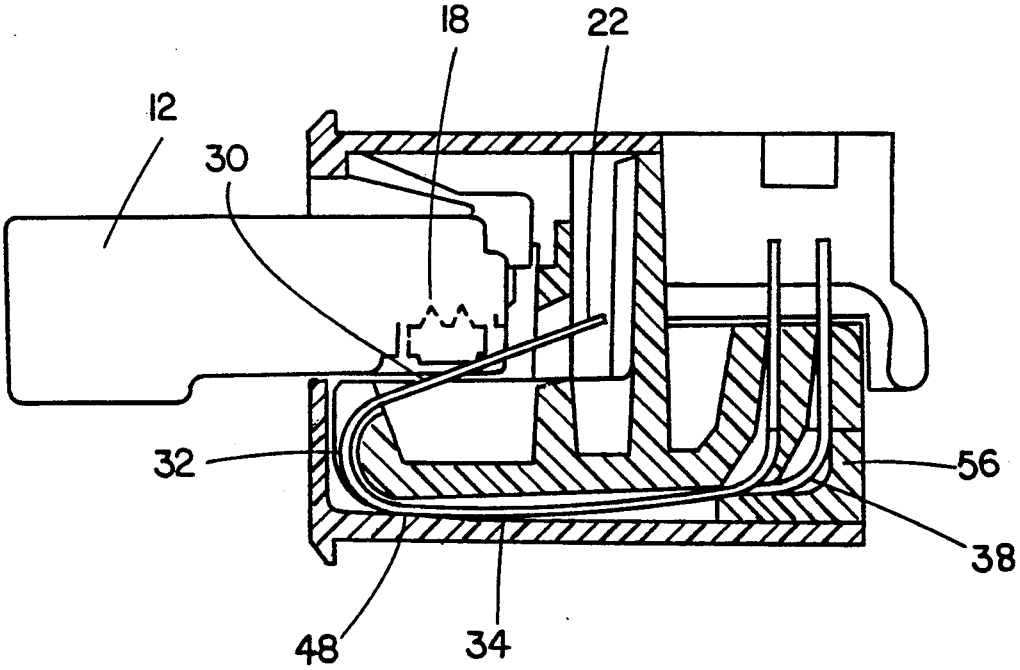
FIG. 13 shows the same view as FIG. 3 but with a plug contact having made contact with the jack spring contact.

Housing 14 includes ledge 48 upon which rests the part of contact 22 near the junction of arcuate portion 32 and mid portion 34. By providing ledge 48, space 50 is formed by the gap between the bottom 52 of the jack body and contact holder 54. Space 50 enables the mid portion 34 of contact 22 to flex downwardly, as shown in FIG. 13, when forces are applied on bearing portion 30 caused by the insertion of plug 12 into cavity 16. By permitting mid portion 34 to deflect downwardly, stresses are relieved on arcuate portion 32.

A part of mid portion 34 as well as curved portion 38 of contact 22 is held within the connector by support 56. Support 56 includes a plurality of lands 58 which contact the shoulders 60 of termination portions 36.

Figure 9:
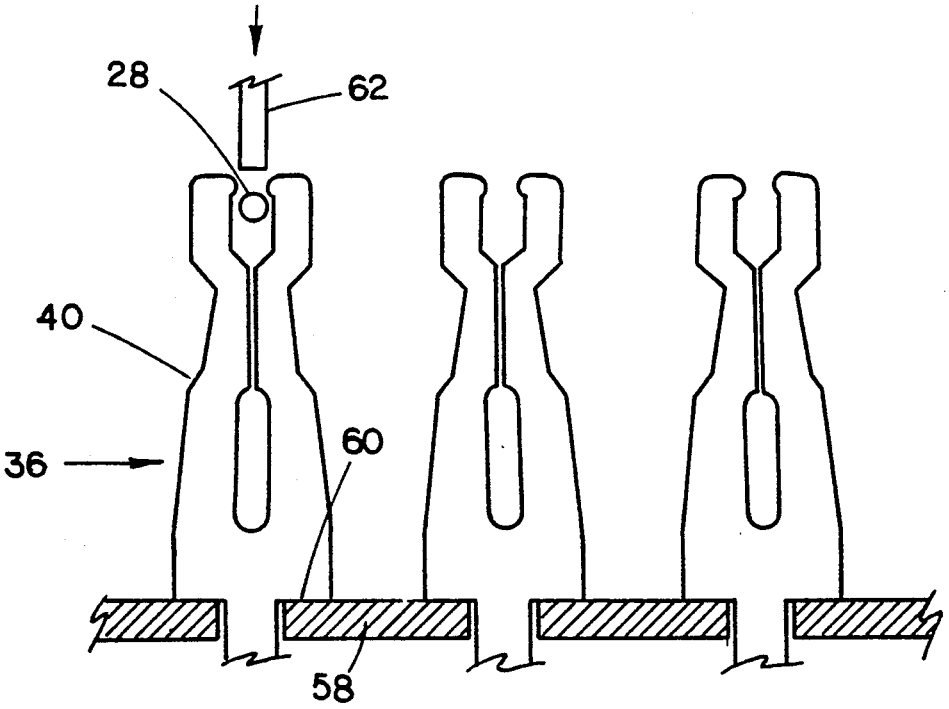
FIG. 9 shows a plurality of termination portions of the contacts received in the housing of the jack shown in FIG. 1.

As can be seen from FIG. 9, wire 28 is stuffed into the insulation displacement contact 40 of termination portion 36 by means of a downwardly pressing stuffer 62 resulting in substantial downward forces at the termination portion 36 of contact 22. Because of the shoulders 60 and the corresponding lands 58, the downward force is not transmitted to the remainder of the contact 22 which could result in deformation of the remainder of the contact, particularly at the curved portion 38.

Contact 40 may be made of various metals including phosphorous/bronze alloys and beryllium copper alloys. Beryllium copper alloys are much more expensive than phosphorous/bronze alloys and are widely used because of the ability of beryllium copper to return to its original shape when under large stresses, whereas phosphorous/bronze is not so forgiving. However, because of the design features described herein, one is able to utilize the cheaper phosphorous/bronze alloys without sacrificing reliability. Thus by widening arcuate portion 32, providing of ledge 48 and the resulting space 50 in the jack, and providing the contacting shoulder 60 and land 58 at the termination end of the contact, one is able to utilize the cheaper phosphorous/bronze alloys while substantially reducing the fear that the contact will be overstressed as a result of overdeflection of the arcuate portion 32 or as a result of the high forces applied during the insertion of wire 28 into insulation displacement contact 40.

Figure 7:
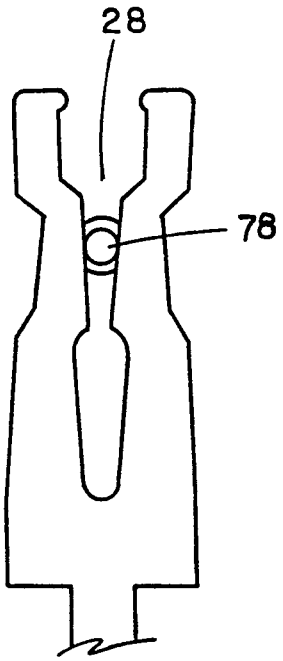
FIG. 7 shows the contact of FIG. 6 with a wire being stuffed therein.

Insulation displacement contact portion 40 of the termination end 36 is designed so as to enable one to utilize both solid and stranded wire, thus making the jack much more flexible. The insulation displacement contact 40 includes wire entry opening 64 formed by jaws 66 and 68. The contact 40 includes slit 70 which is formed in the contact by shearing rather than the typical stamping. This shearing of the contact results in a substantial zero clearance between beams 72 and 74 which provide the forces for terminating wire 28 to contact 22. Because of the zero clearance as opposed to a gap with a width equal to the metal thickness which is normally provided in an insulation displacement contact, a substantially better termination of the wire 28 occurs. Hole 76 is provided to add to the flexibility of the beams 72 and 74, enabling the beams to become open as shown in FIG. 7 as wire 28 is forced into termination by stuffer 62 as shown in FIG. 9.

Figure 8:
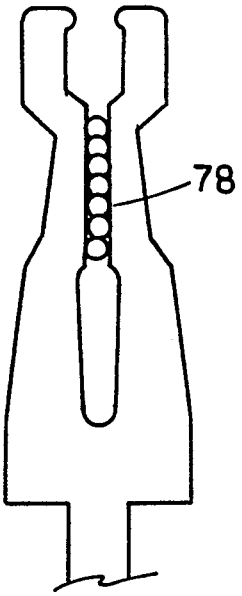
FIG. 8 shows the apparatus of FIG. 6 after the wire stuffing has been completed.

As can be seen, the contact is resilient enough to flex outwardly as wire 28 enters the slit portion 70. However, because of the substantial zero clearance even if the individual strands 78 and a stranded wire become perfectly aligned, as shown in FIG. 8, the contact is enabled to fully close onto the individual strands forming an excellent termination thereof.

From the foregoing description of the preferred embodiment of this invention, it is apparent that many modifications may be made therein without departing from the true scope of the invention.

I claim:

1. An electrical connector comprising:

a housing;

at least one elongated contact received in said housing; said contact having an arcuate portion for providing spring action to said contact; said contact having a bearing portion for engaging a corresponding mating contact; said arcuate portion being wider than said bearing portion, thereby allowing increased deflection of said contact without overstressing said contact.

2. A connector as set forth in claim 1 further including a plurality of said elongated contacts received in said housing.

3. A connector as set forth in claim 1 wherein said contact is substantially made of a phosphorous/bronze alloy.

4. An electrical connector as set forth in claim 1 further including a ledge formed on the inside of said housing; said contact resting on said ledge near said arcuate portion; a space within said housing adjacent to said ledge receiving another portion of said contact whereby said other portion of said contact may flex within said space upon the application of force to said bearing portion thereby relieving stress in said arcuate portion.

5. A connector as set forth in claim 1 wherein at least a portion of the outer surface of said bearing portion of said contact is curved for enabling increased contact pressure between the bearing surface and a corresponding mating contact.

6. A connector as set forth in claim 1 further including a wire termination portion at the opposite end of said contact from said bearing portion.

7. A connector as set forth in claim 6 wherein said wire termination portion includes a wire receiving portion and at least one shoulder on the opposite end from said wire receiving portion; said housing including at least one land contacting said shoulder for thereby reducing pressure on other portions of said contact when wire is stuffed into said wire receiving portion.

8. A connector as set forth in claim 6 wherein said wire termination portion includes an insulation displacement means for terminating wire to said contact.

9. A connector as set forth in claim 8 wherein said insulation displacement means includes a sheared portion forming adjacent beams; said sheared portion providing substantially zero clearance between said adjacent beams along said sheared portion enabling high pressure contact with the wire to be terminated.

10. A connector as set forth in claim 6 wherein said contact includes a mid portion located between said arcuate portion and said wire termination portion; said arcuate portion being wider than said mid portion.

11. A connector as set forth in claim 10 wherein said mid portion includes a curved region.

12. A connector as set forth in claim 11 further including a means for supporting said contact in said curved region.

13. An electrical connector comprising:

a housing;

at least one elongated contact received in said housing; said contact having (a) an arcuate portion for providing spring action to said contact, (b) a bearing portion for engaging a corresponding mating contact, (c) a wire termination portion, and (d) a mid portion located between said arcuate portion and said wire termination portion;

a space formed by upper and lower surfaces in said housing; a portion of said lower surface including a raised ledge; said contact engaging said ledge in the region near said arcuate portion; said mid portion received in said space;

the distance between said upper surface and the portion of said lower surface which does not include said raised ledge being substantially greater than the thickness of said mid portion, whereby said mid portion may flex within said space upon the application of force on said bearing portion whereby stress in said arcuate portion is relieved.

14. A connector as set forth in claim 13 further including a plurality of said contacts.

15. A connector as set forth in claim 13 wherein said contact is substantially made of a phosphorous/bronze alloy.

16. A connector as set forth in claim 13 wherein at least a part of the outer surface of said bearing portion is curved, thereby enabling increased contact pressure between said bearing portion and the corresponding mating contact.

17. An electrical connector comprising:

a housing;

at least one elongated contact received in said housing; said contact having an arcuate portion for providing spring action to said contact and having a bearing portion for engaging a corresponding mating contact;

said housing including a ledge on the inside surface thereof;

said contact engaging said ledge in the region near said arcuate portion;

a space formed in said housing adjacent to said ledge;

another portion of said contact received in said space whereby said another portion may flex within said space upon the application of force on said bearing portion wherein stress in said arcuate portion is relieved; said arcuate portion is wider than said bearing portion.

18. A connector as set forth in claim 13 further including a wire termination portion on the opposite end of said contact from said bearing portion.

19. A connector as set forth in claim 18 wherein said wire termination portion includes a wire receiving portion and at least one shoulder on the opposite end from said wire receiving portion; said housing including at least one land contacting said shoulder thereby reducing pressure on other portions of the contact when wire is stuffed into the wire receiving portion.

20. A connector as set forth in claim 18 wherein said wire termination portion includes an insulation displacement means.

21. A connector as set forth in claim 20 wherein said insulation displacement means includes a sheared portion forming a pair of adjacent beams; said sheared portion providing substantially zero clearance between said adjacent beams; said sheared portion for terminating wire.

22. An electrical connector comprising:

a housing;

at least one elongated contact received in said housing; said contact having an arcuate portion for providing spring action to said contact and having a bearing portion for engaging a corresponding mating contact;

said housing including a ledge on the inside surface thereof;

said contact engaging said ledge in the region near said arcuate portion;

a space formed in said housing adjacent to said ledge;

another portion of said contact received in said space whereby said another portion may flex within said space upon the application of force on said bearing portion wherein stress in said arcuate portion is relieved; a wire termination portion on the opposite end of said contact from said bearing portion; said contact includes a mid portion located between said arcuate portion and said wire termination portion; said arcuate portion being wider than said mid portion.

23. A connector as set forth in claim 22 wherein said mid portion includes a curved region.

24. A connector as set forth in claim 23 wherein said housing includes a means for supporting said curved region.

25. An electrical connector comprising:

a housing;

at least one elongated contact received in said housing; one end of said contact including a wire termination portion; said wire termination portion including an insulation displacement means; said insulation displacement means including a sheared portion forming a pair of adjacent beams;

substantially zero clearance being between said adjacent beams along said sheared portion; said contact includes an arcuate portion providing spring action to the contact; said contact further having a bearing portion for engaging a corresponding mating contact; said arcuate portion is wider than said bearing portion.

26. A connector as set forth in claim 25 wherein said contact is made of a phosphorous/bronze alloy.

27. An electrical connector comprising:

a housing;

at least one elongated contact received in said housing; said contact having an arcuate portion providing spring action for said contact; said contact having a bearing portion for engaging a corresponding mating contact; said contact further including a termination portion; said contact further including a mid portion located between said arcuate portion and said termination portion; said termination portion including at least one shoulder said housing including at least one land contacting said shoulder for reducing pressure on other portions of said contact when wire is terminated to said termination portion; a space formed by upper and lower surfaces in said housing; a portion of said lower surface including a raised ledge; a portion of said contact near said arcuate portion being supported by said ledge; said mid portion of said contact received in said space; the distance between said upper surface and the portion of said lower surface which does not include said raised ledge being substantially greater than the thickness of said mid portion, whereby said mid portion may flex within said space upon the application of force on said bearing portion thereby reducing stress on said arcuate portion.

28. An apparatus as set forth in claim 27 wherein said mid portion includes a curved region; means for supporting said contact in said curved region.

29. An apparatus as set forth in claim 27 wherein said termination portion includes an insulation displacement means; said insulation displacement means including a pair of beams adjacent thereto; a sheared region; substantially zero clearance between said adjacent beams in said sheared region.

* * * * *